United States Patent [19]

Thies

[11] Patent Number: 4,768,287

[45] Date of Patent: Sep. 6, 1988

[54] METHOD FOR JOINING A PLUG CONNECTOR TO A FLAT RIBBON CABLE

[75] Inventor: Werner Thies, Karlsruhe, Fed. Rep. of Germany

[73] Assignee: Siemens Aktiengesellschaft, Munich, Fed. Rep. of Germany

[21] Appl. No.: 59,795

[22] Filed: Jun. 9, 1987

[30] Foreign Application Priority Data

Jun. 9, 1986 [DE] Fed. Rep. of Germany ..... 3619370

[51] Int. Cl.[4] ..... H01R 43/04

[52] U.S. Cl. ..... 29/861; 174/84 C; 174/117 F

[58] Field of Search ..... 174/36, 84 C, 117 F; 29/868, 871, 857, 861, 863

[56] References Cited

U.S. PATENT DOCUMENTS

| | | | |
|---|---|---|---|
| 3,757,029 | 9/1973 | Marshall | 174/117 F X |
| 3,896,259 | 7/1975 | Fry | 174/117 F X |
| 4,287,385 | 9/1981 | Dombrowsky | 174/36 |
| 4,319,075 | 3/1982 | Willette . | |
| 4,345,811 | 8/1982 | Volka . | |
| 4,367,585 | 1/1983 | Elliott et al. | 174/117 F X |
| 4,487,995 | 12/1984 | Hurwitz | 174/84 C |
| 4,488,125 | 12/1984 | Gentry et al. . | |
| 4,551,579 | 11/1985 | Takasaki | 174/84 C X |
| 4,615,114 | 10/1986 | Jones et al. | 29/871 X |

FOREIGN PATENT DOCUMENTS

| | | |
|---|---|---|
| 090494 | 10/1983 | European Pat. Off. . |
| 2208213 | 6/1974 | France . |

OTHER PUBLICATIONS

Promotional Sheet entitled "Abgeschirmtes Rundleiter-Bandkabel mit starker Aussenisolation und Geflechtschirm", of Thomas & Betts.

*Primary Examiner*—Timothy V. Eley
*Assistant Examiner*—Carl J. Arbes
*Attorney, Agent, or Firm*—Kenyon & Kenyon

[57] ABSTRACT

A plug connector is joined to a shielded flat ribbon cable including a plurality of insulated leads disposed laterally adjacent to one another, the cable further including an electrically conducting shielding enveloping the leads. The shielding is severed along the lateral edges of the cable to form a first shielding layer on one side of the cable, the first layer being additionally severed along a zone extending substantially transversely to the leads and peeled back to enable insertion of the plug connector. The second layer is separated from the insulated leads and a first portion of the plug connector is inserted from the side between the separated second layer and the insulated leads. A second portion of the plug connector is disposed in juxtaposition to the insulated leads on the one side of the cable upon completion of the step of peeling. The first portion and the second portion of the plug connector are then pressed against the cable. In a shielded flat ribbon cable utilizable in performing the method, the plurality of insulated leads and the electrically conducting shielding are surrounded by an outer sheath of insulating material provided with a guide groove for facilitaing application of a cutting tool to sever the shielding along the lateral edges of the cable.

5 Claims, 2 Drawing Sheets

FIG.3
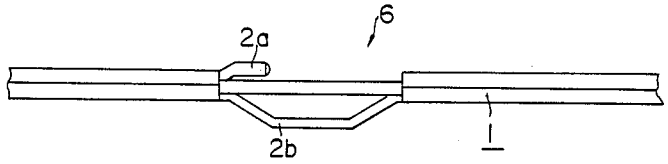
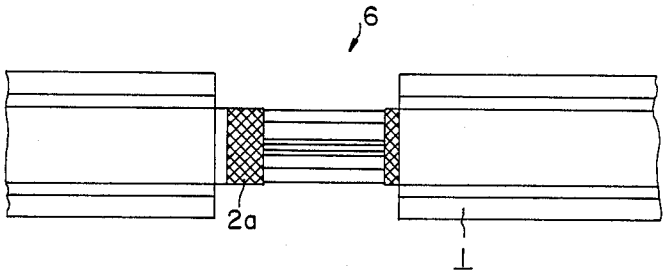
FIG.4
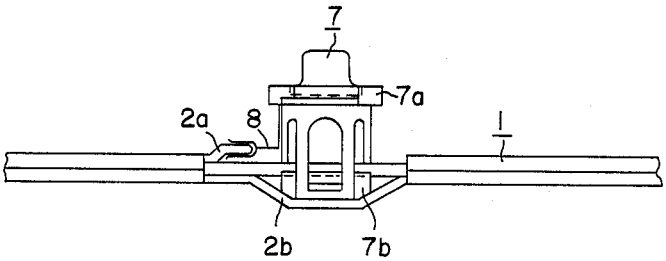
FIG.5
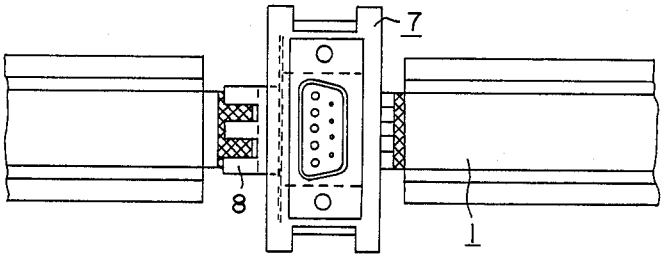
FIG.6

METHOD FOR JOINING A PLUG CONNECTOR TO A FLAT RIBBON CABLE

BACKGROUND OF THE INVENTION

This invention relates to a method for joining a plug connector to a flat ribbon cable. This invention also relates to a cable particularly utilizable in performing the method of the invention.

As described in the publication "*Abgeschirmtes Rundleiter-Bandkabel*" ("Shielded Round Conductor Ribbon Cable") of the firm Thomas & Betts, it has been customarily necessary with shielded flat ribbon cables to interrupt or totally sever the shielding at a connection site along the cable in order to apply a plug connector, exemplarily by the conventional cutting-clamping method. In the use of that method, the plug connector must be simple to apply and should be specifically designed to minimize damage to the shielding and the cable. In order to so minimize damage, separate connections for the shielding at the plug connector must be made.

An object of the present invention is to provide an improved method for joining or attaching a plug connector to a flat ribbon cable.

Another object of the present invention is to provide such a method wherein the attachment of the plug connector to the shielded cable can be effectuated without elaborate severing and reconnections of the shielding.

Yet another object of the present invention is to provide a flat ribbon cable which is specially adapted for use in the improved method of the present invention.

SUMMARY OF THE INVENTION

The instant invention is directed to a method for joining a plug connector to a shielded flat ribbon cable including a plurality of insulated leads disposed laterally adjacent to one another, the cable further including an electrically conducting shielding enveloping the leads. The method pursuant to the invention comprises the steps of (a) severing the shielding at lateral edges of the cable to form a first shielding layer on one side of the cable and a second shielding layer on an opposite side of the cable, (b) severing the first layer along a zone extending substantially transversely to the leads and (c) peeling back the first layer to enable insertion of the plug connector. The method comprises the further steps of (d) separating the second layer from the insulated leads, (e) inserting a first portion of the plug connector between the second layer and the insulated leads and (f) disposing a second portion of the plug connector in juxtaposition to the insulated leads on the one side of the cable upon completion of the step of peeling. The first portion and the second portion of the plug connector are then pressed against the cable and against one another.

A shielded flat ribbon cable utilizable in performing the method of the present invention comprises a plurality of insulated leads disposed laterally adjacent to one another and an electrically conducting shielding enveloping the leads. An outer sheath of insulating material in turn envelopes the shielding, the outer sheath being provided with a guide element for facilitating application of a cutting tool to sever the shielding along lateral edges of the cable. The guide element advantageously takes the form of grooves or recesses in the outer sheath of the cable.

In accordance with another feature of the present invention, the cable is provided along lateral edges with web portions comprising parts of the shielding and parts of the outer sheath, The guide grooves or recesses being provided in the web portions.

In a flat ribbon cable in accordance with the present invention the leads may be twisted together along a plurality of segments of the cable, the cable being provided with one or more identification markings for indicating the locations of segments of the cable wherein the leads are disposed parallel to each other in untwisted relation.

A method in accordance with the present invention for connecting a plug connector to a flat ribbon cable provides a shielding which is free of gaps (the shielding is continuous) and permits the joining of transducers as bus lines to a flat ribbon cable over open feeders. A cable in accordance with the present invention simplifies the preparation of a connection site particularly at the leading or trailing end of the shielded flat ribbon cable.

BRIEF DESCRIPTION OF THE DRAWING

FIG. 3 is a lateral or side elevational view of a cable, in accordance with the present invention, prepared for attachment to a plug connector pursuant to a method according to the present invention.

FIG. 4 is a top or plan view of the cable shown in FIG. 3.

FIG. 5 is a lateral or side elevational view of a cable, in accordance with the present invention, attached to a plug connector pursuant to a method according to the present invention.

FIG. 6 is a top or plan view of the cable shown in FIG. 5.

DETAILED DESCRIPTION

Figure 1:
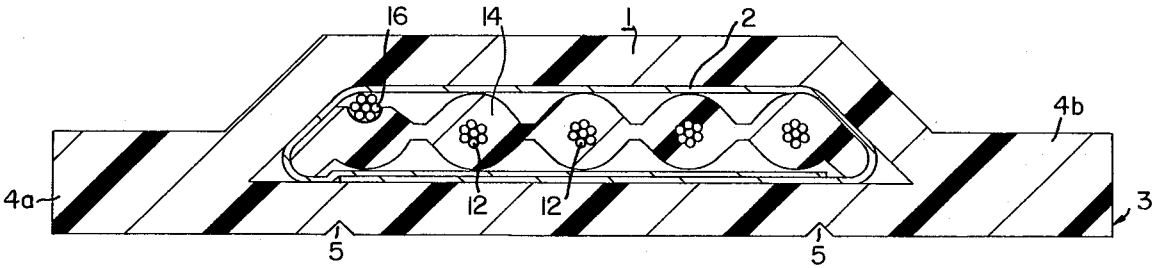
FIG. 1 is a transverse cross-sectional view through a first embodiment of a shielded flat ribbon cable in accordance with the present invention.

As illustrated in FIG. 1, a shielded flat ribbon cable 1 for use in a method in accordance with the present invention comprises four bundles of leads or conductors 12 extending parallel to each other in spaced relation. Lead bundles 12 are encased in an inner insulating sheath 14 in turn enveloped on all sides by a shielding 2 in the form of a copper grid. Another bundle of leads 16 is disposed between inner insulating sheath 14 and copper grid 2 and is in contact with the copper grid. Flat ribbon cable 1 further includes an outer sheath 3 of strong synthetic insulating material for protecting the cable from conductor damage.

Figure 2:
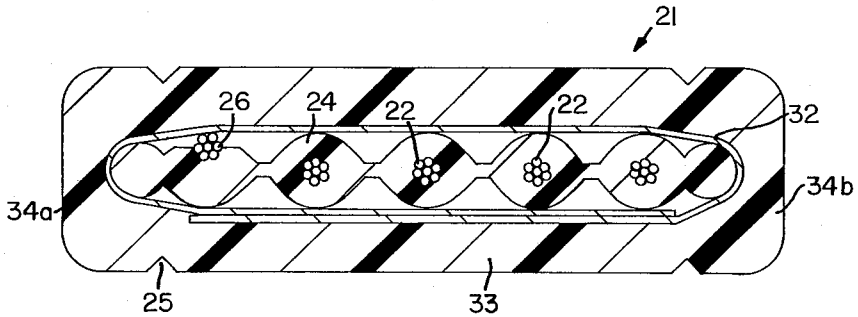
FIG. 2 is a transverse cross-sectional view through a second embodiment of a shieded flat ribbon cable in accordance with the present invention.

As illustrated in FIG. 2, another shielded flat ribbon cable 21 for use in a method in accordance with the present invention comprises four bundles of leads or conductors 22 extending parallel to each other in spaced relation. The bundles of leads 22 are embedded in an inner insulating sheath 24 in turn surrounded on all sides by a copper shielding 32. Another bundle of leads 26 is disposed between inner insulating sheath 24 and copper shielding 32 and is in contact with the shielding. Cable 21 further includes an outer sheath 33 of strong synthetic insulating material which serves to protect the cable from possible conductor damage.

The cables 1 and 21 of FIGS. 1 and 2 differ from one another in the geometries of the inner insulating sheaths 14 and 24 and in the geometries of the outer insulating sheaths 3 and 33. The outer sheath 3 of cable 1 of FIG. 1 is provided on opposite lateral sides or edges with a pair of extended web portions 4*a* and 4*b* each including a part of shielding 2 and a part of the insulating sheath. Outer sheath 33 of cable 21 (FIG. 2) is similarly provided with laterally disposed web portions 34*a* and 34*b*. Lateral web portions 34*a* and 34*b* of cable 21 are reduced in size with respect to web portions 4*a* and 4*b* of cable 1.

As depicted in FIGS. 1 and 2, outer cable sheaths 3 and 33 are provided with grooves or recesses 5 or 25, respectively, for receiving and guiding a cutting tool, thereby facilitating a partial severing of copper shielding 2 or 32 and outer sheath 3 or 33 along the lateral edges thereof.

Instead of a flat ribbon cable, a method in accordance with the present invention can be practiced on a twin lead cable having alternating segments of twisted conductors and parallel conductors. For example, the twin lead cable may have twisted conductor segments of 1000 mm alternating with parallel conductor segments of 50 mm. Pursuant to the present invention, the locations of the parallel conductor segments are marked on an outside surface of synthetic sheat 3 or 33.

A site (see FIGS. 3 and 4) for the attachment of a plug connector can be prepared simply by use of standard tools such as end cutting pliers and scissors (not shown). As a first step, the shielding 2 or 32 is severed along the lateral edges of the cable to form a first shielding layer 2*a* (FIGS. 3 and 5) on one side of the cable and a second shielding layer 2*b* on an opposite side of the cable. In subsequent steps, first layer 2*a* is severed along a zone extending substantially transversely to the lead bundles (14 and 16 in FIG. 1) and peeled back to enable insertion of a plug connector 7 (FIGS. 5 and 6), for example a subminiature D-type plug connector. The second layer 4*b* is then separated from the insulated leads 14, and a first portion 7*b* of plug connector 7 is inserted from the side between the separated second layer 4*b* and the insulated leads 14. A second portion 7*a* of the plug connector is provided with brought-out connections and cutting-clamping contacts, as illustrated in FIG. 6. The cutting-clamping contacts of second portion 7*a* of the plug connector are then brought into contact with the leads of bundles 14, which have been exposed by the standard preparation techniques. To establish the connection using the cutting-clamping technique, the first portion 7*b* and the second portion 7*a* of the plug connector 7 are then pressed against one another and against the exposed leads of the cable. Finally, the first shielding layer 2*a* is connected to a frame or casing of the plug connector by an elastic connecting piece in the form of a spring sheet or web 8.

The connection site including plug connector 7 can be protected from mechanical shocks as well as from dust and moisture by a housing with sealing elements in the conventional manner.

What is claimed is:

1. A method for joining a plug connector to a shielded flat ribbon cable, said cable including a plurality of insulated leads disposed laterally adjacent to one another, said cable further including an electrically conducting shielding enveloping said leads, said method comprising the steps of:

severing the shielding along lateral edges of said cable to form a first shielding layer on one side of said cable and a second shielding layer on an opposite side of said cable;

severing said first layer along a zone extending substantially transversely to said leads;

peeling back said first layer to enable insertion of the plug connector;

separating said second layer from said insulated leads;

inserting a first portion of said plug connector between said second layer and said insulated leads;

disposing a second portion of said plug connector in juxtaposition to said insulated leads on said one side of said cable upon completion of said step of peeling; and pressing said first portion and said second portion of said plug connector against said cable.

2. The method defined in claim 1 wherein said cable further includes an outer sheath of insulating material provided with guide means for facilitating application of a cutting tool to sever said shielding at said lateral edges.

3. The method defined in claim 2 wherein said guide means takes the form of grooves in said outer sheath.

4. The method defined in claim 2 wherein said cable is provided along lateral edges with web portions comprising parts of said shielding and parts of said outer sheath, said guide means being provided in said web portions.

5. The method defined in claim 1 wherein said leads are twisted together along a plurality of segments of said cable, said cable being provided with identification means including markings for indicating segments of said cable wherein said leads are disposed parallel to each other in untwisted relation.

* * * * *